US006405950B1

(12) United States Patent
Gunderson

(10) Patent No.: US 6,405,950 B1
(45) Date of Patent: Jun. 18, 2002

(54) HAMMERMILL AIR RELIEF

(75) Inventor: Lee Gunderson, Dawson, MN (US)

(73) Assignee: Ag Processing Inc, Omaha, NE (US)

( * ) Notice: Subject to any disclaimer, the term of this patent is extended or adjusted under 35 U.S.C. 154(b) by 14 days.

(21) Appl. No.: 09/755,785

(22) Filed: Jan. 5, 2001

(51) Int. Cl.[7] ..... B02C 13/288

(52) U.S. Cl. ..... 241/60; 241/73; 241/74; 241/189.1; 241/194

(58) Field of Search ..... 241/60, 61, 73, 241/74, 189.1, 194, 186.3

(56) References Cited

U.S. PATENT DOCUMENTS 2,291,815 A 8/1942 Korum
2,646,934 A 7/1953 Sandor
2,764,361 A 9/1956 Moore
3,904,132 A 9/1975 Olson
3,904,134 A 9/1975 Olson
4,085,897 A 4/1978 Hahn et al.
4,228,964 A 10/1980 Brady
4,907,750 A 3/1990 Seifert
5,692,688 A 12/1997 Waitman et al.

*Primary Examiner*—Mark Rosenbaum
(74) *Attorney, Agent, or Firm*—McDonnell Boehnen Hulbert & Berghoff

(57) ABSTRACT

This invention relates to an improved airflow hammermill assembly for grinding materials. More particularly, this invention relates to an improved airflow hammermill assembly for processing vegetable meals and cereal grains. The improved airflow hammermill assembly incorporates one or more diverging ducts communicating with the hammermill housing to provide a more uniform negative pressure within the housing. The improved airflow hammermill assembly allows increased throughput and energy savings.

15 Claims, 4 Drawing Sheets

HAMMERMILL AIR RELIEF

FIELD OF THE INVENTION

This invention relates to an improved airflow hammermill assembly for grinding materials. More particularly, this invention relates to an improved airflow hammermill assembly for processing vegetable meals and cereal grains. The improved airflow hammermill assembly incorporates one or more diverging ducts communicating with the hammermill housing to increase the effective discharge area for upper portions of the collection zone and provide a more uniform negative pressure within the housing. The improved airflow hammermill assembly allows increased throughput and energy savings.

BACKGROUND OF THE INVENTION

Hammermills used for particle size reduction typically comprise a housing having a feed inlet at the top, a grinding chamber beneath the feed inlet, and a ground material outlet at the bottom of the housing beneath the grinding chamber. The grinding chamber is defined by a classification grid (usually an apertured screen) surrounding a rotor mounted on a driven shaft for rotation about an axis. When the classification grid is an apertured screen, it is commonly cylindrical (also termed "full-circle), although other configurations can be employed, including arcuate shapes, such as oval or teardrop (also termed "tear-circle"), and polygonal shapes. A number of impact members are fixedly or pivotably attached to the rotor. Typically, the impact members comprise rectangular pieces of hardened steel, commonly termed hammers, pivotably mounted to the rotor to be free-swinging when the rotor spins.

During hammermill operation, material is fed by gravity through the housing feed inlet and into the grinding chamber. Inside the grinding chamber, the rotating rotor causes the ends of the hammers to swing out and strike the material to be ground, thereby reducing particle size until the particles are fine enough to pass as finished product through the classification grid. Particles too coarse to pass through the classification grid are retained in the grinding chamber and subjected to repeated impacts until they become sufficiently reduced in size to exit.

During grinding of material in a hammermill, particle size reduction occurs as a result of the impact between a relatively rapidly moving hammer and a relatively slowly moving particle. The hammers of a hammermill typically rotate at a speed in excess of 15,000 feet per minute. By contrast, free-flowing material coming into the grinding chamber generally enters at a much lower rate of less than about 100 feet per minute. Given such a large difference in relative velocity, the initial contact of the hammer with the material produces an explosive impact, transferring sufficient energy to the material to break it into smaller particles that are then accelerated toward the classification grid. Depending on their size and angle of approach, the smaller particles either pass through the classification grid or rebound from the screen to be subjected to additional hammer impacts and further size reduction.

After the first impact, particles in the grinding chamber tend to be accelerated in the direction of hammer rotation and very quickly approach the hammer tip speed. This acceleration lessens the speed differential between the hammer and the particle, which lessens the impact force and hence lessens the size reduction that results from subsequent impacts, thereby reducing grinding efficiency.

Many devices exist for improving grinding efficiency. One approach to achieving efficient grinding is to inhibit particle acceleration. Particles are accelerated in the grinding chamber in part due to the impact itself. A common method for inhibiting particle acceleration is to redirect or interrupt the path of travel of the particle within the grinding chamber. Many hammermill designs commonly employ baffles or other deflectors within the grinding chamber for this purpose. When accelerated particles strike the baffles, they rebound or at least are momentarily halted, facilitating further high-energy impacts and effective subsequent grinding. Another common method for inhibiting particle acceleration is to employ a classification grid having a polygonal or otherwise non-circular shape. The irregular shape of a polygonal or non-circular classification grid induces flow interruptions in the same fashion as baffles, thereby increasing the particle-to-hammer speed differential in subsequent impacts. However, baffle-particle and/or classification grid-particle collisions tend to cause equipment and product heating, leading to power losses and making product more difficult to grind.

Grinding efficiency is also affected by the fanning action of the rotor on the air in the grinding chamber. One effect of rotor fanning action is that it contributes to particle acceleration; however, this problem can be addressed as described above by using baffles and/or polygonal or otherwise non-circular screens. A greater problem associated with rotor fanning action is that it produces internal recirculation of air within the hammermill, which can create a low-pressure area at the hammermill outlet. Such a low-pressure area creates a suction effect that can draw fines and other lighter ground material back into the grinding chamber, thereby reducing the capacity of the grinding chamber to receive new material. In grinding heavier materials such as corn, the ground material can have sufficient weight to discharge from the hammermill outlet without being affected significantly by a low-pressure area. But with lighter materials such as oats, or with commercial materials that are to be reduced to fine powders, a low-pressure area can have a significant effect in drawing back into the grinding chamber a substantial portion of the material that would otherwise discharge.

To prevent finished product drawback as well as other problems caused by internal air recirculation, a blower or exhaust fan is often connected with the hammermill outlet to create reduced air pressure within the unit. Such so-called negative air or negative pressure systems assist the grinding process by facilitating continuous flow of ground material out of the hammermill. However, in attempting to increase output by increasing the negative pressure on the hammermill, the increased velocity of air at the hammermill outlet tends to cause feed material to take a direct path from the hammermill inlet directly to the bottom of the grinding chamber, rather than staying in continuous suspension within the grinding chamber, and thereby decreases effective use of the upper portion of the grinding chamber and classification grid.

Under such operating conditions, ground particles tend to exit mainly from that portion of the classification grid that is positioned directly above the housing outlet, where airflow is most rapid. The effective discharge area for ground material exiting from the remaining portions of the classification grid then tends not to be the housing outlet, but rather the area determined dimensionally by the width of the classification grid multiplied by the distance between the classification grid and the housing at the narrowest gap in the vicinity of the housing outlet. Increasing the air exhaust rate worsens this phenomenon by tending to create "constrictive zones" of product buildup at the effective discharge area, where ground material passing through upper portions of the classification grid tends to become stalled and cannot freely and continuously exit the housing. Release of ground product above the constrictive zones occurs only after such product accumulates in a weight amount sufficient to overcome the nonuniform airflow conditions that create the constrictive zones. Thus a cycle of clogging and release occurs, and unwelcome power surges become a common occurrence. Throughput is greatly reduced because the relatively large fraction of the classification grid that serves upper portions of the collection zone essentially becomes nonusable.

The above and other approaches in grinding apparatus design have not been satisfactory. Consequently, further improvements in grinding apparatus designs have been sought. The present invention relates to an improved airflow hammermill assembly having advantages over those previously disclosed. The improved airflow hammermill assembly of the invention increases throughput by distributing airflow more evenly throughout the apparatus, thereby enabling creation of a more uniform negative air pressure and increasing the effective discharge area for upper portions of the collection zone.

SUMMARY OF THE INVENTION

One aspect of the present invention relates to an improved airflow hammermill assembly that grinds material into particles of a desired size in a way that minimizes clogging of material in the grinding chamber and assures progressive grinding in a continuous and efficient manner.

Another aspect of the present invention relates to an improved airflow hammermill assembly that allows increased throughput and energy savings.

Yet another aspect of the present invention relates to an improved airflow hammermill assembly that minimizes power surges and associated amperage fluctuations. Still another aspect of the present invention relates to an improved airflow hammermill assembly that incorporates a diverging duct communicating with the hammermill housing to provide a more uniform negative pressure within the grinding chamber and increase the effective discharge area for upper portions of the collection zone.

A still further aspect of the present invention relates to an improved airflow hammermill assembly that incorporates at least two diverging ducts communicating with the hammermill housing to provide a more uniform negative pressure within the grinding chamber and increase the effective discharge area for upper portions of the collection zone.

One embodiment of the invention is an improved airflow hammermill assembly comprising a housing having an inlet, an outlet, and a plurality of side walls; a rotor mounted within the housing on a shaft for rotation about an axis; a classification grid within the housing substantially surrounding the rotor and defining an inner grinding chamber and an outer collection zone; a plurality of impact members attached to the rotor, the impact members disposed longitudinally along the rotor within the inner grinding chamber, advantageously in a configuration such that rotating impact members sweep through an area that is at least 50 percent of the classification grid area; a diverging duct mounted on one of the housing side walls, the diverging duct having a discharge end and an entrance end communicating with the outer collection zone; and a blower communicating with the housing outlet and the diverging duct discharge end to establish negative pressure within the housing and facilitate continuous flow of ground material out of the hammermill.

Another embodiment of the invention is an improved airflow hammermill assembly comprising a housing having an inlet, an outlet, and a plurality of side walls; a rotor mounted within the housing on a shaft for rotation about an axis; a classification grid within the housing substantially surrounding the rotor and defining an inner grinding chamber and an outer collection zone; a plurality of impact members attached to the rotor, the impact members disposed longitudinally along the rotor within the inner grinding chamber, advantageously in a configuration such that rotating impact members sweep through an area that is at least 50 percent of the classification grid area; a diverging duct mounted on one of the housing side walls, the diverging duct having a discharge end and an entrance end communicating with the outer collection zone at a position parallel to or beneath the grinding chamber; and a blower communicating with the housing outlet and the diverging duct discharge end to establish negative pressure within the housing and facilitate continuous flow of ground material out of the hammermill.

A further embodiment of the invention is an improved airflow hammermill assembly comprising a housing having an inlet, an outlet, and a plurality of side walls; a rotor mounted within the housing on a shaft for rotation about an axis; a classification grid within the housing substantially surrounding the rotor and defining an inner grinding chamber and an outer collection zone; a plurality of impact members attached to the rotor, the impact members disposed longitudinally along the rotor within the inner grinding chamber, advantageously in a configuration such that rotating impact members sweep through an area that is at least 50 percent of the classification grid area; at least two diverging ducts mounted on one of the housing side walls, each diverging duct having a discharge end and an entrance end communicating with the outer collection zone; and a blower communicating with the housing outlet and the diverging duct discharge end to establish negative pressure within the housing and facilitate continuous flow of ground material out of the hammermill.

A still further embodiment of the invention is an improved airflow hammermill assembly comprising a housing having an inlet, an outlet, and a plurality of side walls; a rotor mounted within the housing on a shaft for rotation about an axis; a classification grid within the housing substantially surrounding the rotor and defining an inner grinding chamber and an outer collection zone; a plurality of impact members attached to the rotor, the impact members disposed longitudinally along the rotor within the inner grinding chamber, advantageously in a configuration such that rotating impact members sweep through an area that is at least 50 percent of the classification grid area; at least two diverging ducts mounted on one of the housing side walls, each diverging duct having a discharge end and an entrance end communicating with the outer collection zone at a position parallel to or beneath the grinding chamber; and a blower communicating with the housing outlet and the diverging duct discharge end to establish negative pressure within the housing and facilitate continuous flow of ground material out of the hammermill.

These and other aspects and embodiments of the invention will become apparent in light of the detailed description below.

DESCRIPTION OF A PREFERRED EMBODIMENT

Figure 1:
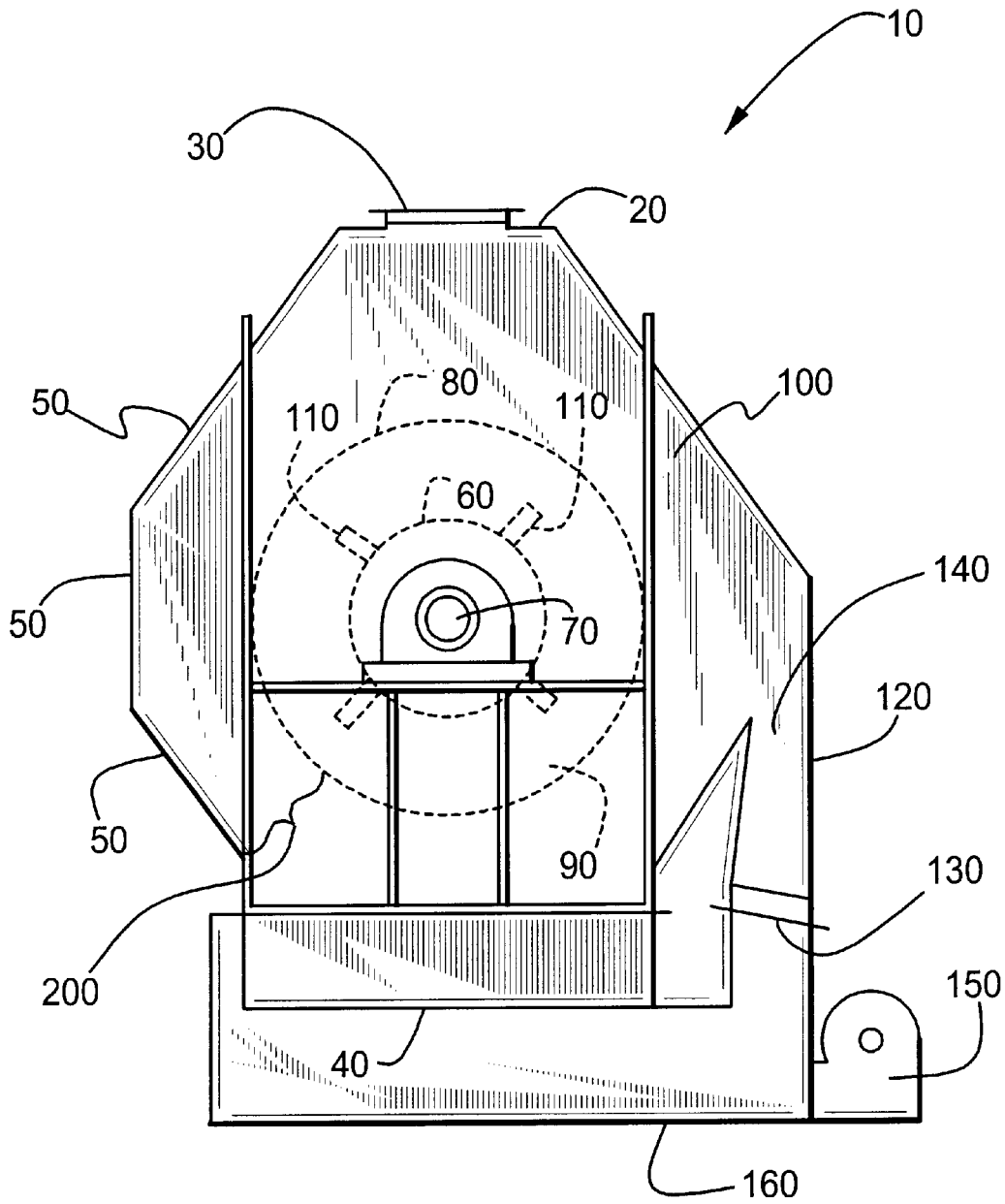
FIG. 1 is a front elevational view of an improved airflow hammermill assembly having a single diverging duct arranged in accordance with the present invention.
Figure 3:
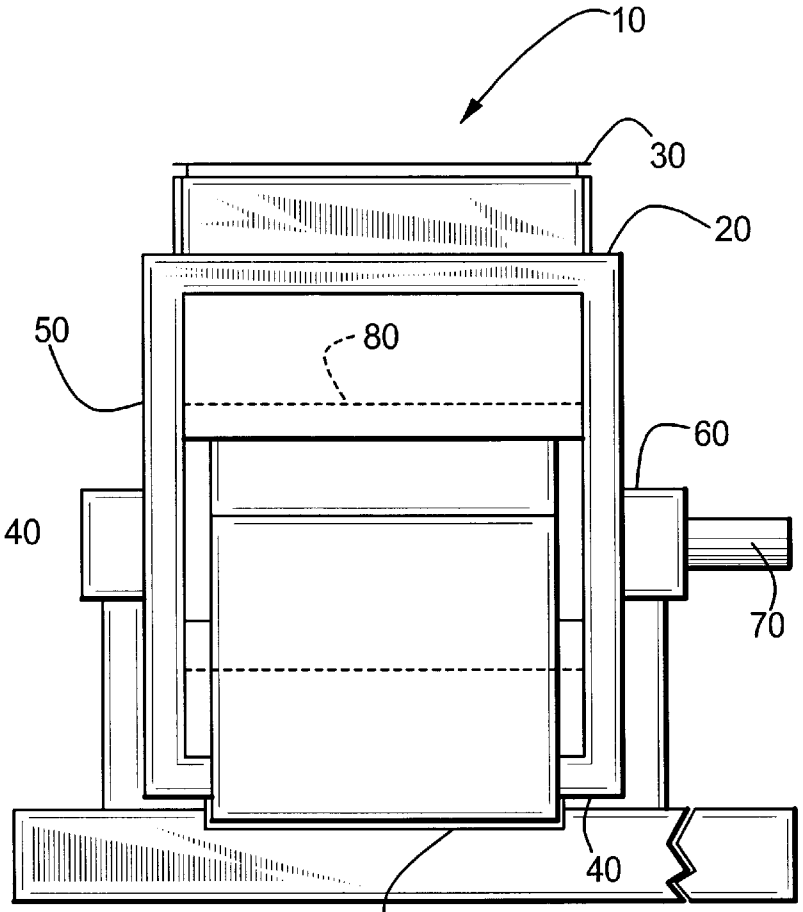
FIG. 3 is a partial side elevational view of the hammermill assembly arrangements of FIG. 1 and FIG. 2, taken from the right-hand side.

Reference numeral 10 of FIGS. 1, 2, 3, and 4 generally indicates an improved airflow hammermill assembly embodying the improvements of the present invention. Assembly 10 comprises housing 20, which is formed by a plurality of fixed and spaced apart side walls 50, and which has an inlet 30 and an outlet 40. Side walls 50 are generally composed of steel or other metal, and are suitably bonded together, as by a suitable welding technique, so as to fully fill all joints between and defined by them. Generally, housing 20 is polygonal in shape, and preferably has the form of an octagon, although other polygon shapes are also suitable.

Housing 20 has an inlet 30, through which material that is to be ground or shredded into smaller particles of preselected size can flow into the housing. Housing 20 also has an outlet 40 through which ground material can exit or be withdrawn after it has been reduced to a target size. Dimensionally, outlet 40 can be and often is as large in area as the entire base of the housing 20.

Almost any feed material can be successfully reduced in size via operation of the hammermill of the invention, including rubber and cellulosic material such as newsprint. Preferably, however, the feed material is a plant-derived substance such as vegetable meal or cereal grains. Most preferably, the feed material is oats, soybean meal, or corn. Feed material generally enters inlet 30 via the action of gravity. Conveniently, feed material is supplied to inlet 30 via a conveyer or screw feed system.

A rotor 60 and classification grid 80 are mounted within the housing in coaxial relation to the central axis of the housing, about which axis the rotor is rotated. Rotor 60 is mounted on a shaft 70 that can rotate either clockwise or counterclockwise.

The classification grid 80 is mounted such that it substantially but not completely surrounds the rotor 60, at least some open space remaining through which feed material can enter. Classification grid 80 defines an inner grinding chamber 90 and an outer collection zone 100. Typically, classification grid 80 is either a unitary apertured screen or is assembled from two or more apertured screen sections that fit together to form a substantially cylindrical or teardrop shape.

Many different aperture profiles and configurations are suitable for use in the present invention. Aperture profiles generally fall within one of the four basic categories of round, square, slot, or other geometric. The aperture profiles can be configured in geometric pattern to generally fall within one of the three classes of straight, staggered, and angled. Suitable geometric pattern/aperture profile combinations include but are not limited to 60 degree/round, 45 degree/round, straight/round, straight/square, staggered/square, hexagon/round, and diamond/round. Preferably, the aperture screen pattern is straight/round, staggered/round, or diamond/round. Most preferably, the aperture screen pattern is diamond-staggered/round. The apertured screen has a mesh size in accordance with the size reduction desired. When the apertures are round, they typically have a diameter of from 1/64 inch to 2 inches. Preferably, classification grid 80 comprises an apertured screen composed of a plurality of 10/64-inch diameter holes arranged in a diamond pattern and sufficient in number to ensure that the classification grid 80 comprises at least about 36 percent open area, such a configuration also referred to herein as a 10/64 screen.

A plurality of impact members 110 are attached to the rotor 60, the impact members typically disposed in multiple groups longitudinally along the rotor 60 within the grinding chamber 90. Impact members 110 can be either fixedly or rotatably attached to rotor 60 and are attached so as to dispose their ends in close adjacency to classification grid 80. However, the impact members 110 are spaced far enough apart from classification grid 80 so that the main grinding action occurs by impact members striking material in mid-air and without rubbing or grinding the material between the impact members 110 and the classification grid 80. Preferably, impact members 110 comprise rectangular pieces fabricated from an abrasion-resistant metal such as case-hardened steel.

Figure 5:
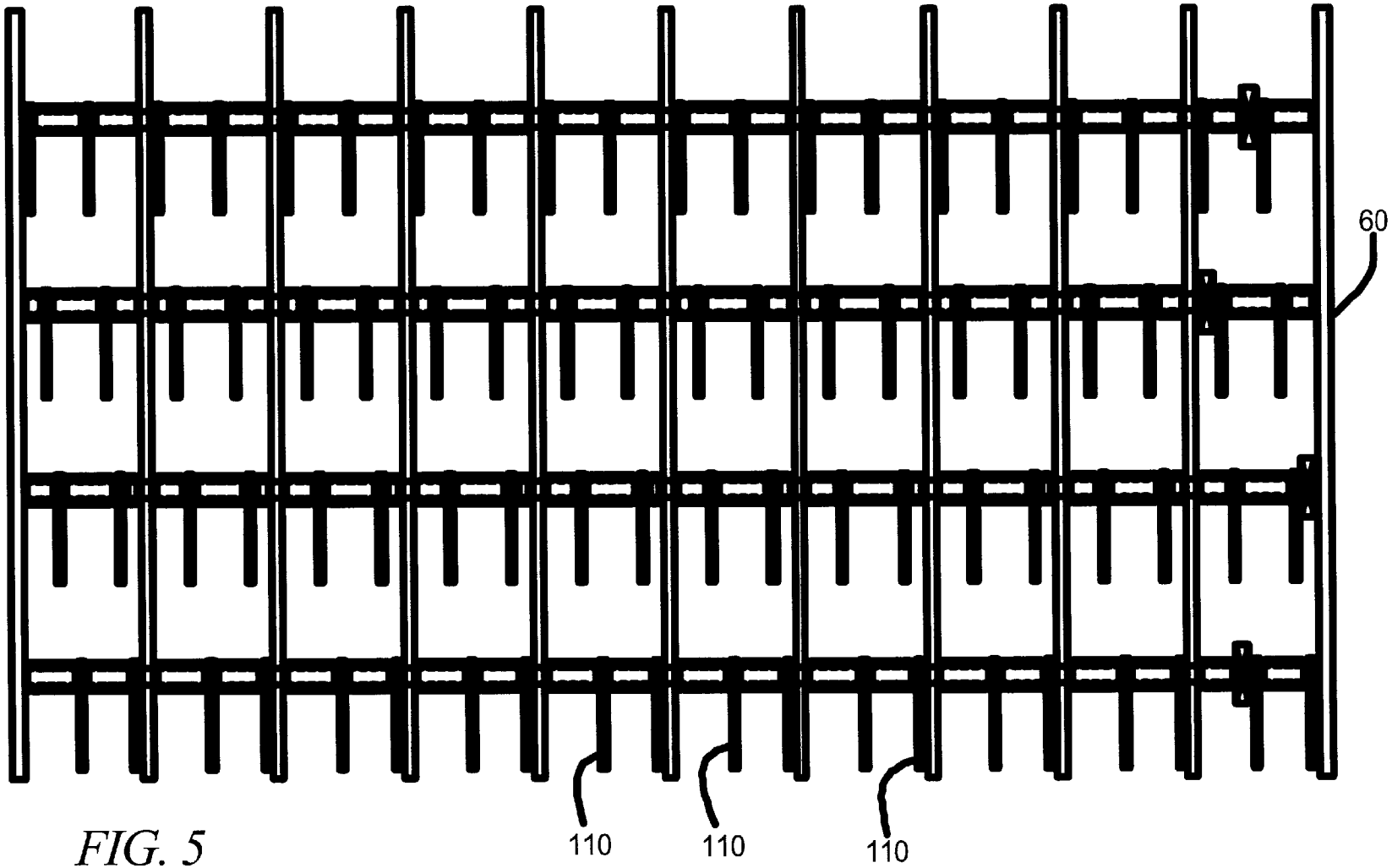
FIG. 5 illustrates a typical impact member configuration in accordance with the present invention.

The number and diameter of impact members 110 generally depends on the material to be ground and the area of classification grid 80. Preferably, however, impact members 110 are staggered longitudinally along rotor 60 such that the rotating impact members sweep through an area that is at least about 50 percent of the classification grid area. Generally, the number and size of impact members 110 for any particular application must be carefully selected, keeping in mind the fact that rotating impact members themselves generate air flow that can affect particle velocity and can affect classification grid clogging. In one particularly preferred impact member configuration as illustrated in FIG. 5, a total of 80 hammers one-quarter inch in diameter are attached to rotor 60 in a staggered fashion such that no hammer defines the same rotational path of travel as any other and such that the impact members sweep through an area amounting to 55 percent of a 36-inch wide classification grid.

As stated above, grinding efficiency is affected by the fanning action of the rotor on the air in the grinding chamber, which produces internal recirculation of air within the hammermill and can create a low-pressure area at the hammermill outlet, thereby having a significant effect in drawing back into the grinding chamber a substantial portion of the material that would otherwise discharge. To prevent finished product drawback, operators often connect blowers to the hammermill outlet in order to reduce air pressure within the unit and facilitate continuous flow of ground material out of the hammermill. Most operators and equipment designers follow this principle, which generally recommends maximizing negative pressure on the hammermill. However, increasing the velocity of air at the hammermill outlet tends to cause feed material to take a direct path from the hammermill inlet directly to the bottom of the grinding chamber, thereby decreasing effective use of the upper portion of the grinding chamber and classification grid. Moreover, a large pressure gradient can result, where the pressure at the bottom of the grinding chamber is significantly less than the pressure at the top, increasing the tendency for particles entering the grinding chamber to immediately accelerate straight to the bottom, thereby contributing to product accumulation on the classification grid.

Under such operating conditions, ground particles tend to exit mainly from that portion of the classification grid that is positioned directly above the housing outlet, where airflow is most rapid. The effective discharge area for ground material exiting from the remaining portions of the classification grid then tends not to be the housing outlet, but rather the area determined dimensionally by the width of the classification grid multiplied by the distance between the classification grid and the housing at the narrowest gap in the vicinity of the housing outlet. Increasing the air exhaust rate worsens this phenomenon by tending to create "constrictive zones" of product buildup at the effective discharge area, illustrated by reference numeral 200 in FIG. 1, where ground material passing through upper portions of the classification grid tends to become stalled and cannot freely and continuously exit the housing. Release of ground product above the constrictive zones occurs only after such product accumulates in a weight amount sufficient to overcome the nonuniform airflow conditions that create the constrictive zones. Thus a cycle of clogging and release occurs, and unwelcome power surges become a common occurrence. Throughput is greatly reduced because the relatively large fraction of the classification grid that serves upper portions of the collection zone essentially becomes nonusable.

Figure 2:
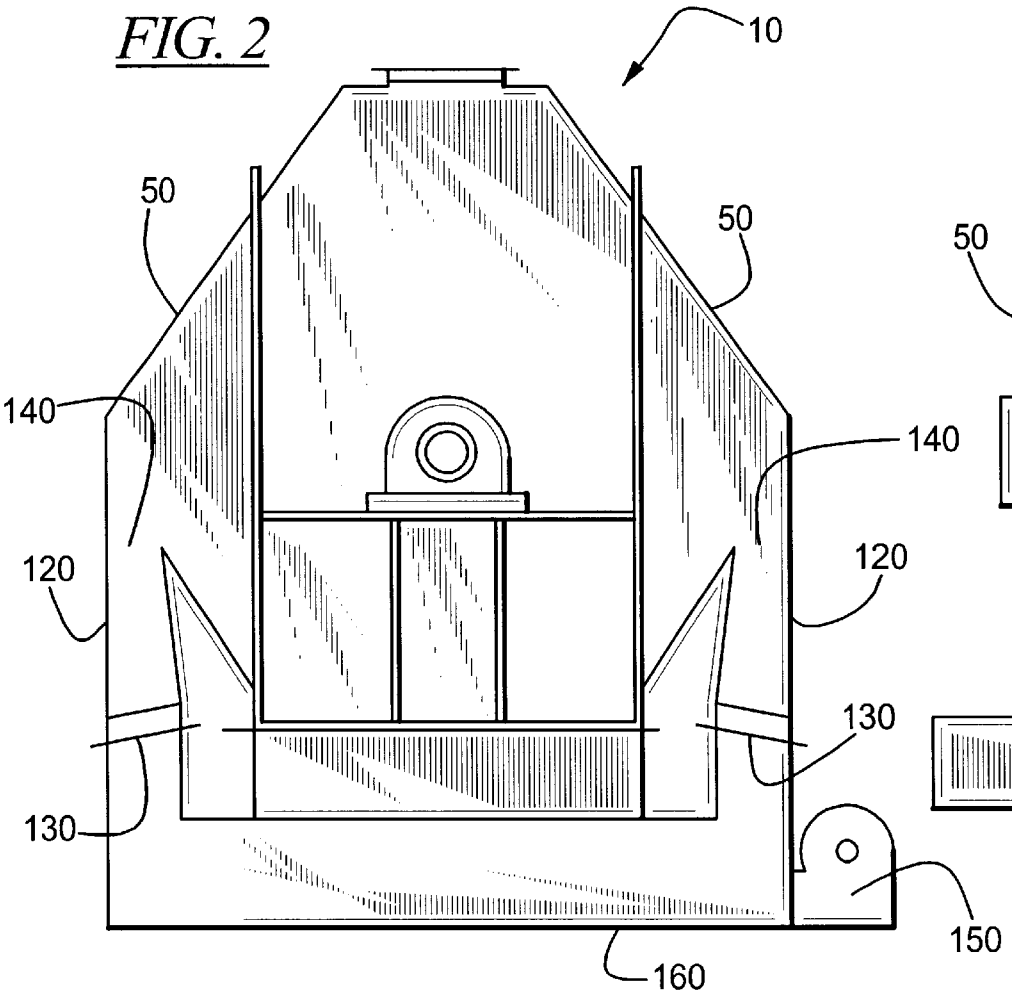
FIG. 2 is a front elevational view of an improved airflow hammermill assembly having a pair of diverging ducts arranged in accordance with the present invention.

To overcome such difficulties, the present invention employs at least one diverging duct 120 mounted on one of the side walls 50. The use of one diverging duct 120 as illustrated in FIG. 1 significantly improves performance compared to a design without such diverging ducts. As illustrated in FIG. 2, when two or more diverging ducts 120 are used, even greater performance can be realized. Diverging duct 120 has a discharge end 130 and an entrance end 140 communicating with the outer collection zone 100. Because the cross sectional area of diverging duct 120 increases as it approaches discharge end 130, the velocity of air trying to escape diverging duct 120 is reduced, thereby reducing any tendency for a pressure gradient to develop within the inner grinding chamber 90 and outer collection zone 100. The use of diverging duct 120 allows maintaining a balanced negative air pressure across the entire circumference of classification grid 80, thereby allowing product to enter and be ground evenly throughout inner grinding chamber 90 and allowing product to pass evenly into outer collection zone 100. Such an effect dramatically reduces amperage fluctuations caused by the build-up/release phenomenon often experienced with other hammermill designs. Such an effect also dramatically increases grinding efficiency and throughput. Preferably, the discharge end 130 of diverging duct 120 has a substantially rectangular cross-sectional area.

To complete the hammermill design of the present invention, a blower 150 communicates via intake ducts 160 with housing outlet 40 and diverging duct discharge ends 130 to generate negative pressure and assist removal of ground material from outer collection zone 100. During operation of the hammermill, blower 150 draws air through the housing inlet 30, through the inner grinding chamber 90 and outer collection zone 100, and lastly into intake ducts 160. Blower 150 can communicate with the housing outlet and the diverging duct discharge end through a common intake duct 160 or can communicate via multiple separate intake ducts 160.

Figure 4:
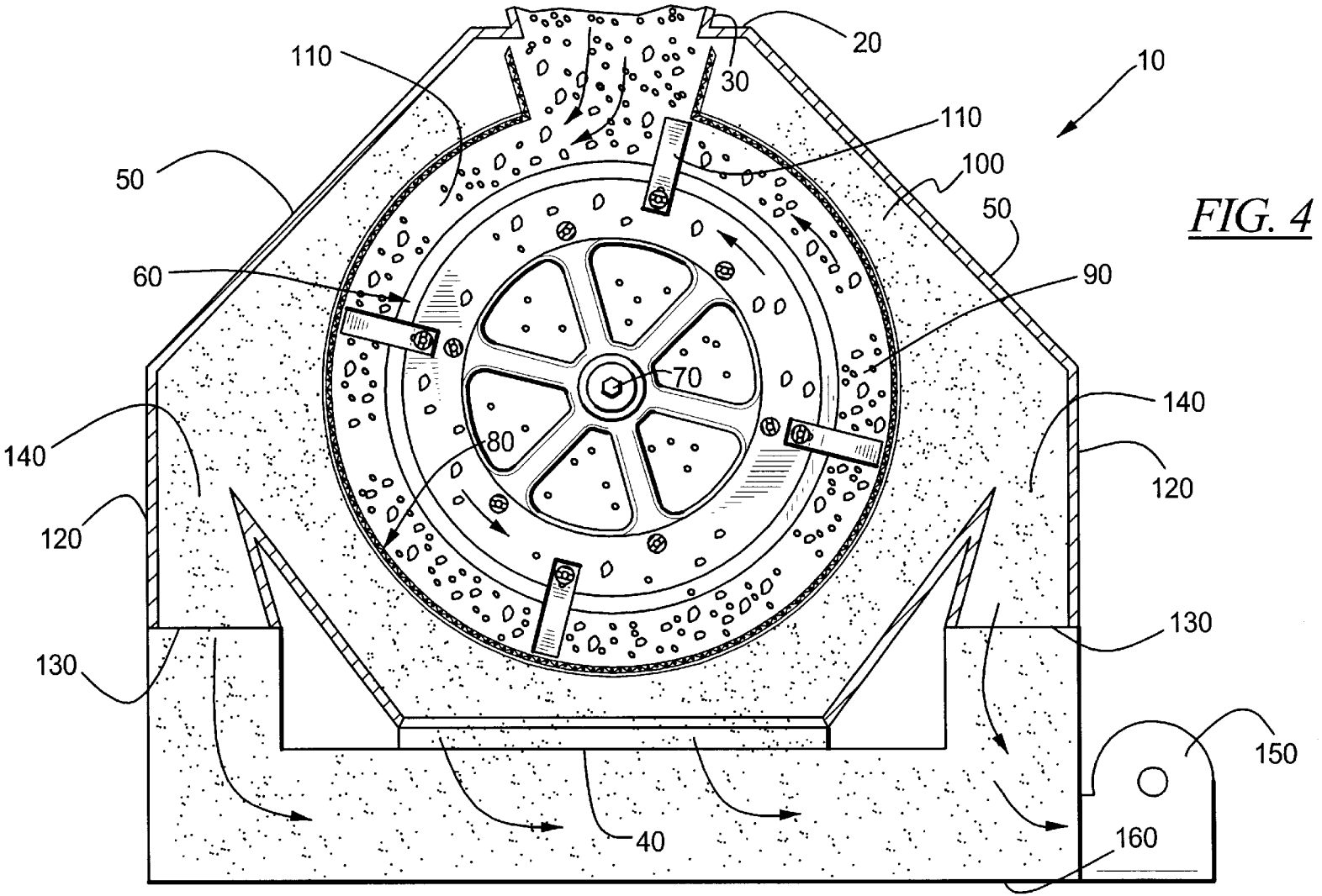
FIG. 4 is a fragmental front elevational view of the hammermill assembly of FIG. 2 illustrating particulate matter in the process of entering, being acted on within the grinding chamber, passing through the classification grid, and flowing through and out of the outer collection zone.

As illustrated in detail in FIG. 4, in one preferred embodiment of the present invention, a rotor equipped with the impact member configuration illustrated in FIG. 5 rotates at a speed of about 1200 rpm within an inner grinding chamber 90 and classification grid 80 each having a width of about 36 inches. At the position of closest approach near the vicinity of housing outlet 40, i.e. the potential constrictive zone/effective discharge area for upper portions of the collection zone, the classification grid 80 is three inches from housing 20, thus presenting an effective discharge area for the upper collection zone of about 108 square inches. Two diverging ducts 120 are employed, each having a rectangular cross-sectional area of about 180 square inches at the discharge end 130. Hence, in this embodiment, the use of diverging ducts 120 adds 360 square inches to the original 216 square inches of effective discharge area for particles trying to exit upper portions of the collection zone. Thus, little or no product buildup occurs in the potential constrictive zones, providing for a more uniform negative pressure throughout the hammermill assembly, increasing throughput, and providing for little or no amperage fluctuations.

All documents, e.g., patents, journal articles, and textbooks, cited above or below are hereby incorporated by reference in their entirety.

One skilled in the art will recognize that modifications may be made in the present invention without deviating from the spirit or scope of the invention. The invention is illustrated further by the following examples, which are not to be construed as limiting the invention in spirit or scope to the specific procedures or compositions described therein.

EXAMPLE 1

As one illustration of the benefit imparted by use of a diverging duct 120, the following specific but non-limiting example is discussed. A particular hammermill assembly similar in design to that illustrated in FIGS. 2 and 4 but not having any diverging ducts utilized a 36-inch wide substantially cylindrical 10/64 screen and 60 hammers having a one-quarter-inch diameter. The screen comprised two sections each, 36 inches wide and 50 inches in arc length, assembled to form a cylinder having a gap at the bottom. Of the screen's 3600 square inches of total area, a diamond-staggered/round hole aperture configuration provided 36 percent, or 1296 square inches of total open area.

The housing outlet had an area of about 1575 square inches. However, at the classification grid's position of closest approach near the vicinity of housing outlet, i.e. the potential constrictive zone/effective discharge area for upper portions of the collection zone, the classification grid was three inches from away the housing. Thus, the effective discharge area for the upper collection zone tended to be not the housing's 1575 square inches, but rather only about 216 square inches (108 square inches on either side of the housing). Product tended to build up and form a constrictive zone at the effective discharge area for the upper collection zone, which then produced the effect that only the screen portion beneath the constrictive zone was being utilized, i.e. only about 3/11, or about 354 square inches, of the total 1296 square inches of open area of the screen was being utilized. Although the manufacturer rated this hammermill design to have a throughput of up to 105,000 pounds per hour, throughput was only about 35,000 to 40,000 pounds per hour of soybean meal. A continual product buildup/release phenomenon occurred, and amperage fluctuations on the motor driving the rotor were as much as 100 amps.

The hammermill was modified to include one diverging duct having a cross-sectional area of about 600 square inches at the entrance end and 180 square inches at the discharge end. Throughput increased to about 60,000 pounds per hour and amperage fluctuations were reduced considerably.

EXAMPLE 2

A hammermill as modified in Example 1 but containing two identical diverging ducts as described in Example 1 and employing 80 hammers having a one-quarter inch diameter and arranged in the configuration illustrated in FIG. 5 produced a throughput of 65,000 to 70,000 pounds per hour of soybean meal. The motor driving the rotor drew a steady amount of amps and never reached shut off/overload limits.

The invention and the manner and process of making and using it, are now described in such full, clear, concise and exact terms as to enable any person skilled in the art to which it pertains, to make and use the same. Although the foregoing describes preferred embodiments of the present invention, modifications may be made therein without departing from the spirit or scope of the present invention as set forth in the claims. To particularly point out and distinctly claim the subject matter regarded as invention, the following claims conclude this specification.

What I claim is:

1. A hammermill, comprising:

(a) a housing having an inlet, an outlet, and a plurality of side walls;

(b) a rotor mounted within the housing on a shaft for rotation about an axis;

(c) a classification grid within the housing substantially surrounding the rotor and defining an inner grinding chamber and an outer collection zone;

(d) a plurality of impact members attached to and disposed longitudinally along the rotor within the inner grinding chamber;

(e) a diverging duct mounted on one of the housing side walls, the diverging duct having a discharge end and an entrance end communicating with the outer collection zone; and (f) a blower communicating with the housing outlet and the diverging duct discharge end to establish negative pressure within the housing and facilitate continuous flow of ground material out of the hammermill.

2. The hammermill of claim 1, wherein the impact members are disposed in a configuration such that rotating impact members sweep through an area that is at least about 50 percent of the classification grid area.

3. The hammermill of claim 1, wherein the diverging duct entrance end communicates with the outer collection zone at a position parallel to or beneath the grinding chamber.

4. The hammermill of claim 1, wherein the classification grid is an apertured screen.

5. The hammermill of claim 4, wherein the apertured screen is substantially cylindrical.

6. The hammermill of claim 5, wherein the apertured screen comprises at least two arcuate sections.

7. The hammermill of claim 1, wherein the rotor is reversible.

8. The hammermill of claim 1, wherein the diverging duct extends substantially across the width of the collection zone.

9. The hammermill of claim 1, wherein the diverging duct has a substantially rectangular cross-sectional area.

10. The hammermill of claim 1, wherein the blower communicates separately with the housing outlet and the diverging duct discharge end.

11. The hammermill of claim 1, wherein the impact members are pivotably attached to the rotor.

12. The hammermill of claim 1, wherein there are at least about 80 impact members.

13. A hammermill, comprising:

(a) a housing having an inlet, an outlet, and a plurality of side walls;

(b) a rotor mounted within the housing on a shaft for rotation about an axis;

(c) a classification grid within the housing substantially surrounding the rotor and defining an inner grinding chamber and an outer collection zone;

(d) a plurality of impact members attached to and disposed longitudinally along the rotor within the inner grinding chamber;

(e) at least two diverging ducts mounted on opposite side walls of the housing, the diverging ducts each having a discharge end and an entrance end communicating with the outer collection zone; and (f) a blower communicating with the housing outlet and the diverging duct discharge ends to establish negative pressure within the housing and facilitate continuous flow of ground material out of the hammermill.

14. The hammermill of claim 13, wherein the impact members are disposed in a configuration such that rotating impact members sweep through an area that is at least about 50 percent of the classification grid area.

15. The hammermill of claim 13, wherein the diverging duct entrance ends communicate with the outer collection zone at a position parallel to or beneath the grinding chamber.

* * * * *